US005938572A

United States Patent [19]

Spano

[11] Patent Number: 5,938,572

[45] Date of Patent: Aug. 17, 1999

[54] RESISTANCE TRAINING DEVICE

[76] Inventor: Joanne Spano, 133 Lakeshore Dr. West, Putnam Valley, N.Y. 10579

[21] Appl. No.: 09/006,943

[22] Filed: Jan. 14, 1998

[51] Int. Cl.[6] ..... A63B 21/06

[52] U.S. Cl. ..... 482/105

[58] Field of Search ..... 482/105; 224/222, 224/267, 609, 42.11

[56] References Cited

U.S. PATENT DOCUMENTS

| | | | |
|---|---|---|---|
| 1,729,209 | 9/1929 | Curtice . | |
| 2,408,160 | 9/1946 | Brunner . | |
| 3,278,184 | 10/1966 | Rosenbaum . | |
| 3,306,610 | 2/1967 | Biggs, Jr. et al. . | |
| 3,334,898 | 8/1967 | McCrory . | |
| 3,427,020 | 2/1969 | Mountour et al. . | |
| 3,528,652 | 9/1970 | Tarbox | 482/105 |
| 3,910,577 | 10/1975 | Boyle . | |
| 4,239,211 | 12/1980 | Wilkerson | 482/105 |
| 4,258,869 | 3/1981 | Hilgendorff | 224/609 X |
| 5,074,549 | 12/1991 | Harvey | 482/105 |
| 5,127,891 | 7/1992 | Winston | 482/105 |
| 5,573,483 | 11/1996 | Nay | 482/105 |

*Primary Examiner*—John Mulcahy
*Attorney, Agent, or Firm*—Joseph L. Spiegel

[57] ABSTRACT

A weight resistance exercise training device for placement above the knee, comprising a pair of flexible side compartments containing weight material, a central flexible compartment containing weight material adapted to be engaged across a person's limb and interconnecting the side compartments, whereby the side compartments may depend from the person's limb when the central compartment is engaged across the limb. Each side compartment has an underside with a pocket secured to same and has a flap for releasably securing weights within the pockets. A pair of dowels is embedded within the device at the interconnection between the side compartments and central compartments. A strap is secured to each side compartment underside and provided with fasteners for attachment of the straps together and securement of the device to the person's limb.

4 Claims, 2 Drawing Sheets

RESISTANCE TRAINING DEVICE

BACKGROUND OF THE INVENTION

1. Field of the Invention

The present invention relates to exercise training devices, and, in particular, to resistance training devices for placement above the knee, useful in toning, shaping, tightening and sculpting the muscle in the hips, buttocks and inner and outer thigh areas.

2. Description of the Prior Art

The prior art is replete with exercise training devices.

The U.S. Pat. No. 1,729,209 to Curtice discloses a band with pockets into which weights are placed, with means for securing same about a person's wrist or ankle.

In Brunner, U.S. Pat. No. 2,408,120, weights are suspended from a band that is engaged across a person's foot.

Rosenbaum, U.S. Pat. No. 3,278,184 pertains to an encircling anklet with a plurality of vertical pockets for containing weights.

Biggs, Jr., et al, U.S. Pat. No. 3,306,610 discloses a training spat adapted to be worn over the shoe of an athlete with bar weights disposed in the vertical pockets on each side of the spat.

McCrory, et al, U.S. Pat. No. 3,334,898, discloses a pocketed wrap with removable weights adapted to be disposed around the ankle of a person's foot.

In Mountour, et al, U.S. Pat. No. 3,427,020, a spat-shaped flexible legging has closed pockets containing granular weights.

Boyle, U.S. Pat. No. 3,910,577 discloses an exercising device with pouches containing interchangeable weights joined by a web adapted to be draped over a person's limb.

None of the prior art is useful in the areas to which the present invention is applicable.

SUMMARY OF INVENTION

The principal object of the invention is a weight resistance exercise training device which is intended for placement above the knee and is useful in toning, shaping, tightening and sculpting the muscles in the hips, buttocks and inner and outer thigh areas.

These and other objects, features and advantages of the present invention are accomplished in accordance with the teachings of the present invention, one illustrative embodiment of which comprises a weight resistance exercise training device that includes a pair of flexible weighted side compartments and a central flexible, weighted compartment interconnecting the side compartments. Straps secure the device to the upper part of a person's leg. With the central compartment engaged across a person's limb, the side compartments depend therefrom. The device is useful in toning, shaping, tightening and sculpting muscles in the hips, buttocks and inner and outer thigh areas.

BRIEF DESCRIPTION OF THE DRAWING

Other objects, features and advantages of the present invention will be apparent from the following detailed description and accompanying drawing wherein.

DETAILED DESCRIPTION

Figure 1:
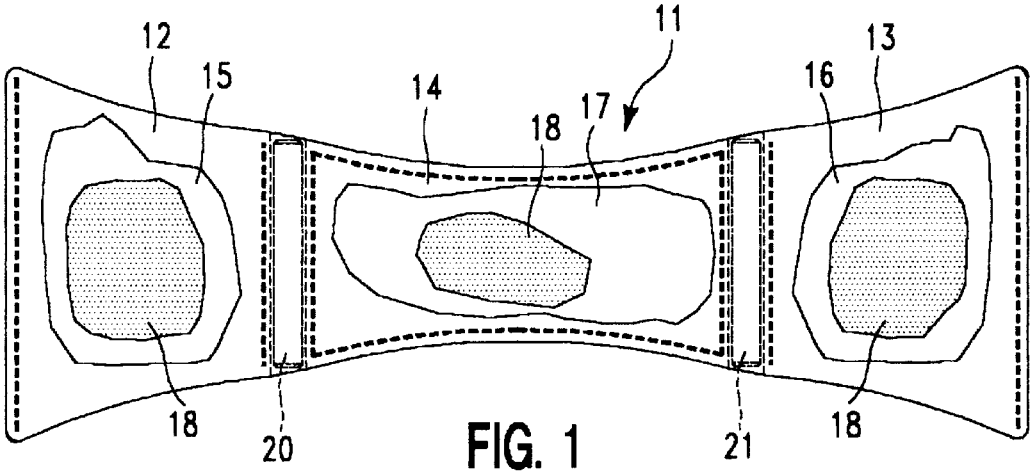
FIG. 1 is a top view of the resistance training device of the present invention.
Figure 2:
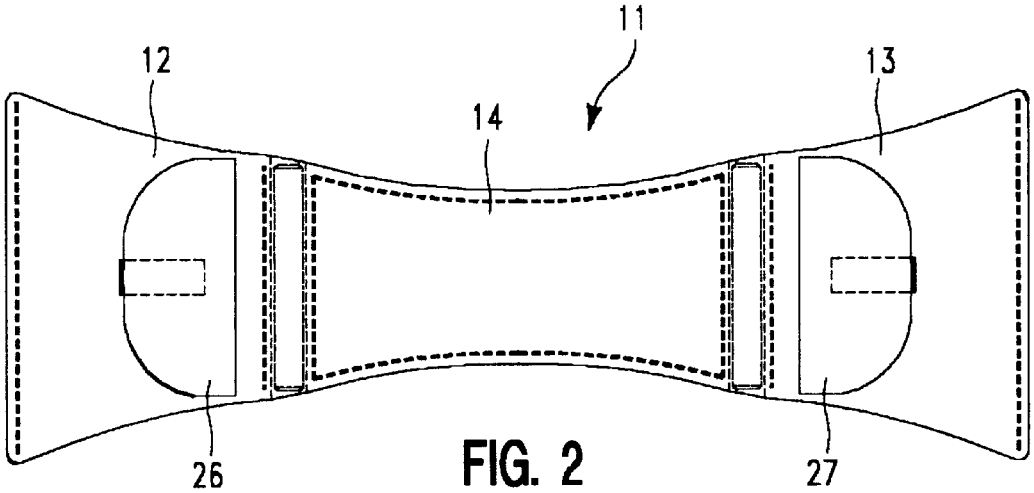
FIG. 2 is a bottom view of the device of FIG. 1.
Figure 3:
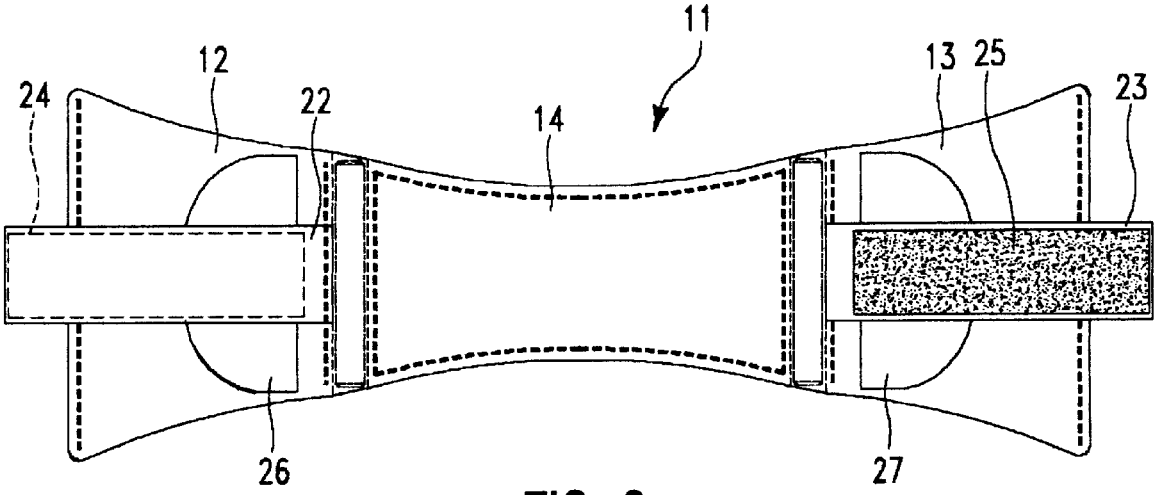
FIG. 3 is a bottom view of the device with the addition of its elastic securement straps.
Figure 4:
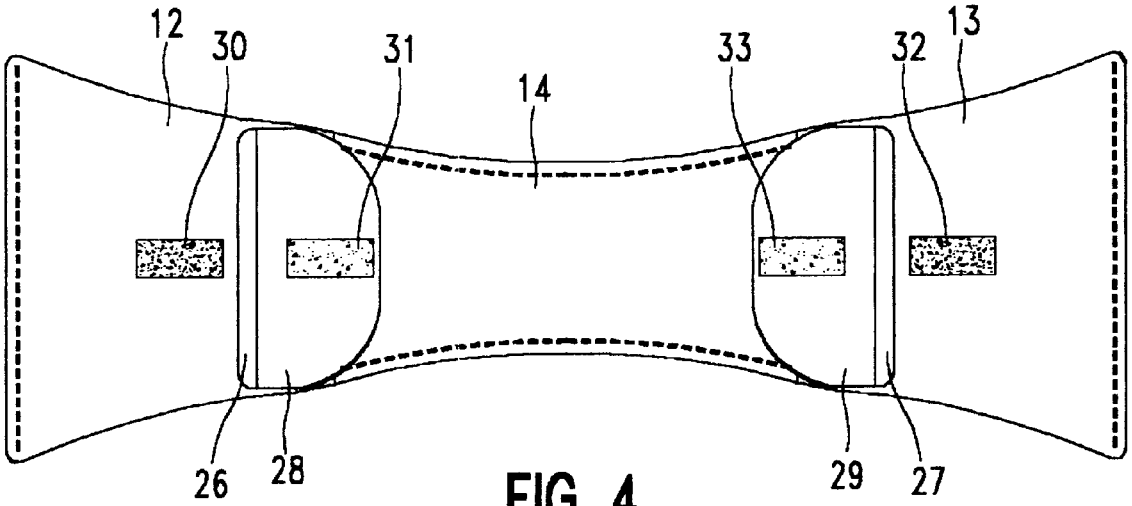
FIG. 4 is a bottom view of the device with the addition of pockets for adding weight; and, FIG. 5 is a side view of the device.
Figure 5:
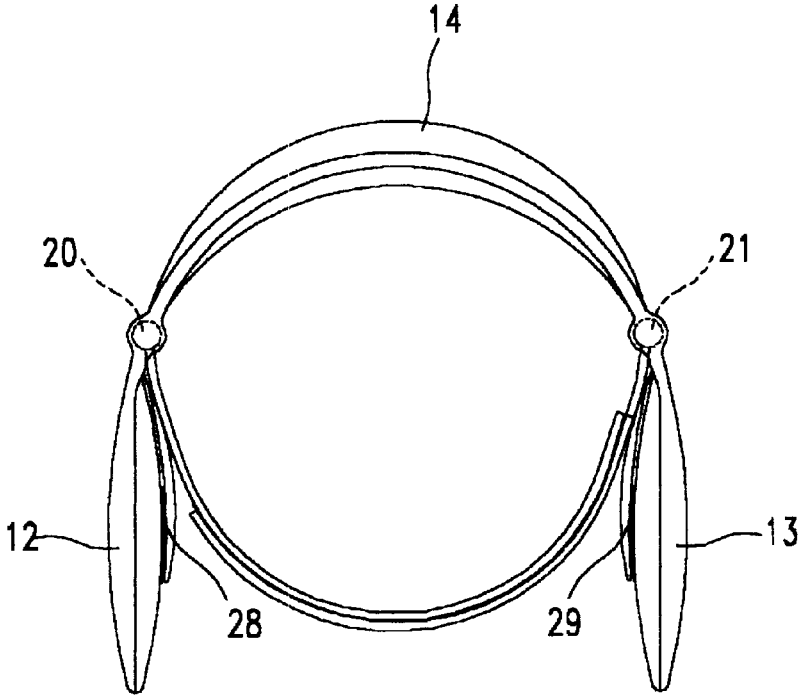

Referring now to the drawing, there is shown a weight resistance exercise training device 11 for placement above the knee and constructed in accordance with the teachings of the present invention.

The device is seen as including three joined together compartments, a pair of flexible side compartments 12, 13, and a flexible central crescent shaped compartment 14 interconnecting the side compartments 12, 13. Each compartment contains a divided pouch 15, 16, 17 filled with weight material 18. In a preferred embodiment the compartments are made of duck cloth fabric, the pouches of plastic or vinyl and the weight material is sand.

In a typical embodiment the central compartment contains one-half pound of sand and the side compartments each one-quarter a pound.

The side compartments 12, 13 are divided from the central compartment 14 by means of separators 20, 21. In one embodiment the separators are wooden dowels sewn into the body of the side compartments.

The separators 20, 21 enable proper placement or positioning of the side compartments as well as enabling the device to be used in upright or standing position exercises.

Elastic straps 22, 23 are secured to the underside of each side compartment 12, 13. The straps 22, 23 are equipped with some form of closure means as, for example, Velcro hook and loops fastener material 24, 25.

The straps 22, 23 allow securement of the device 11 to the upper part of the leg, without restriction, and keep the device 11 in place while moving in various exercises, when exercising in upright or standing positions, and allow the device to be turned easily when changing to different exercises.

The underside of each side compartment is provided with a pocket 26, 27 to allow for the addition of weight discs for progression or additional resistance.

Each pocket has a flap 28, 29 for better containment and cosmetic purposes. Some form of closure means of the flap on the pocket is provided for as, for example, Velcro hook and loop fastener material 30, 31 and 32, 33.

The pocket weight discs are made of condensed lead and the like and may be covered with material for cosmetic purposes. Typically the discs are one-half pound and one pound, sized to fit into the side compartments.

In use, after the device 11 has been strapped into place, with the center compartment 14 positioned across an upper part of the leg, the side compartments 12, 13 drop into position, for best resistance and ultimate isolation while enhancing balance.

The comfortable design also ensures equal weight distribution.

When placed above the back of the knee, the side compartments will drop down allowing one to lift an equal amount of weight on each side. This positioning forces isolation of the gluteal muscles (buttocks), enables excellent resistance and enhances balance.

When placed above the side of the knee, the side compartments 12, 13 will drop to hang over the front and back of the leg allowing one to lift equal weight, forcing isolation of muscles in the outer thigh or inner thigh depending on placement side.

It should be obvious that changes, additions and omissions may be made in the detail and arrangement of parts without departing from the scope of the invention as defined in the appended claims.

What is claimed is:

1. A weight resistance excercise training device for placement above the knee, comprising:

a pair of flexible side compartments containing weight material;

a central flexible compartment containing weight material adapted to be engaged across a person's limb and interconnecting the side compartments, whereby the side compartments may depend from the person's limb when the central compartment is engaged across the limb;

each side compartment having an underside; and, a strap secured to each side compartment underside where the side compartments are interconnected to the central compartment and provided with fasteners for attachment of the straps together and securement of the device to the person's limb.

2. The invention described by claim 1 including a pocket secured to each side compartment underside and having a flap for releasably securing weight within the pocket.

3. The invention defined by claim 1 including separator means embedded within the device at the interconnection between the side compartments and central compartment.

4. A weight resistance exercise training device for placement above the knee, comprising:

a pair of flexible side compartments containing weight material;

a central flexible compartment containing weight material adapted to be engaged across a person's limb and interconnecting the side compartments, whereby the side compartments may depend from the person's limb when the central compartment is engaged across the limb;

each side compartment having an underside;

a pocket secured to each side compartment underside and having a flap for releasedly securing weights within the pocket;

a pair of dowels embedded within the device at the interconnection between the side compartments and central compartment; and, a strap secured to each side compartment underside where the side compartments are interconnected to the central compartment and provided with fasteners for attachment of the straps together and securement of the device to the person's limb.

* * * * *